US007044271B2

(12) United States Patent
De Coi

(10) Patent No.: US 7,044,271 B2
(45) Date of Patent: May 16, 2006

(54) SAFETY DEVICE FOR PINCHING ZONE OF ELEVATOR DOORS

(75) Inventor: Beat De Coi, Bergwerkstrasse (CH)

(73) Assignee: Cedes AG, Landquart (CH)

( * ) Notice: Subject to any disclaimer, the term of this patent is extended or adjusted under 35 U.S.C. 154(b) by 258 days.

(21) Appl. No.: 10/314,319

(22) Filed: Dec. 9, 2002

(65) Prior Publication Data

US 2004/0108171 A1 Jun. 10, 2004

(30) Foreign Application Priority Data

Jun. 13, 2000 (CH) ..... 1162/00

(51) Int. Cl.
*B66B 13/14* (2006.01)

(52) U.S. Cl. ..... 187/316; 49/28

(58) Field of Classification Search ..... 187/313, 187/316, 317, 391; 29/26, 28, 25, 31; 318/466–470; 382/103, 325; 340/545.1, 552
See application file for complete search history.

(56) References Cited

U.S. PATENT DOCUMENTS

| | | | | | |
|---|---|---|---|---|---|
| 4,029,176 | A | * | 6/1977 | Mills | 187/317 |
| 4,452,009 | A | * | 6/1984 | Baumeler et al. | 49/25 |
| 4,621,452 | A | * | 11/1986 | Deeg | 49/28 |
| 5,732,795 | A | * | 3/1998 | McCarthy et al. | 187/250 |
| 5,925,858 | A | | 7/1999 | Full et al. | |
| 6,304,178 | B1 | * | 10/2001 | Hayashida | 340/545.1 |
| 6,333,865 | B1 | * | 12/2001 | Yumura et al. | 363/132 |
| 6,341,668 | B1 | * | 1/2002 | Fayette et al. | 187/391 |
| 6,382,361 | B1 | * | 5/2002 | Nihei et al. | 187/289 |
| 6,408,986 | B1 | * | 6/2002 | Ayano et al. | 187/290 |
| 6,412,604 | B1 | * | 7/2002 | Schuster | 187/290 |
| 6,631,788 | B1 | * | 10/2003 | Nakashima et al. | 187/316 |
| 6,732,839 | B1 | * | 5/2004 | Schuster | 187/391 |
| 2001/0045328 | A1 | * | 11/2001 | Pustelniak et al. | 187/317 |

FOREIGN PATENT DOCUMENTS

| | | |
|---|---|---|
| DE | 299 06 535 U1 | 10/1999 |
| EP | 0698714 A1 | 8/1995 |
| FR | 1548379 | 12/1968 |
| JP | 07149489 | 6/1995 |
| JP | 08026639 | 1/1996 |

* cited by examiner

*Primary Examiner*—Jonathan Salata
(74) *Attorney, Agent, or Firm*—Buchanan Ingersoll pc

(57) ABSTRACT

The described safety mechanism is embodied for elevator systems with an elevator car, which can be displaced in an elevator shaft. The entrances to the elevator shaft and to the elevator car each have at least one sliding door, which is automatically operable by a drive mechanism, preferably arranged on the elevator car. At least one detector device is provided at each sliding door, which is placed in the area of a pinching edge between a sliding door and a door jamb, and/or between two adjoining sliding door panels. Depending on the detected state of the monitored areas, the detector device generates a door release signal, or provides the interruption of the drive mechanism for opening the sliding door. The signals from the detector devices at the sliding doors of the elevator shaft can be received as a function of the position of the elevator car. In this case only the signals from the detector device from the sliding door of the elevator shaft can be considered, which is to be automatically opened next, together with the sliding door of the elevator car.

23 Claims, 5 Drawing Sheets

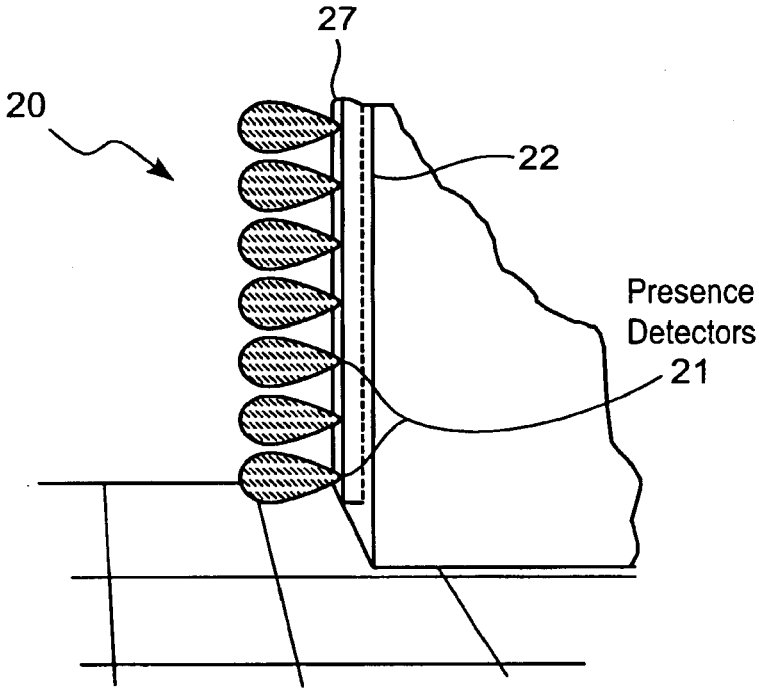
FIG. 3
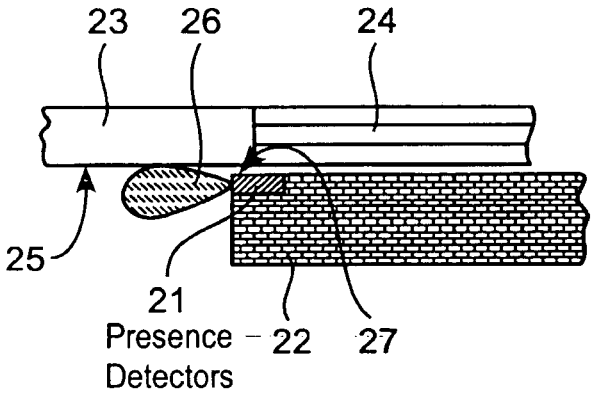
FIG. 4
FIG. 6
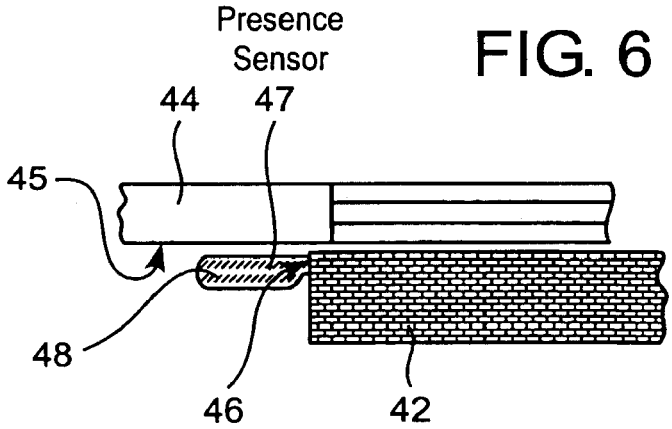

SAFETY DEVICE FOR PINCHING ZONE OF ELEVATOR DOORS

RELATED APPLICATIONS

This application claims priority under 35 U.S.C. §§119 to Swiss Application 2000 1162/00 filed in Switzerland on Jun. 13, 2000, and under 35 U.S.C. §120 to PCT/CH01/00352 filed as an International Application on Jun. 7, 2001, and designating the United States, the entire contents of which are hereby incorporated by reference in their entireties.

BACKGROUND

1. Field of the Invention

The invention relates to a safety mechanism for elevator systems. The invention also relates to a method for operating the safety mechanism in accordance with the invention.

2. Background Information

The elevator cars, as well as the elevator shaft of elevator systems which meet modern safety requirements are customarily provided with automatically operable sliding doors. Depending on the size of the door opening, these can be single- or multi-panel individual sliding doors, or centrally opening double sliding doors. In various elevator systems, the different door types can also be combined with each other. While the closing process of automatic sliding doors generally no longer poses problems, since closing force limiters are usually provided, a large potential for improvement continues to exist in regard to the opening process. The problematic area with automatically opening sliding doors lies in particular at the pinching edge between the surface of the door panel and the door jamb. With multi-panel sliding doors there are additionally analogous pinching edges between the surface of the respective door panel and the front edge of the further panel element adjoining it in the direction of the door jamb.

The sliding doors of known elevator systems pose a definite risk that an object leaning against the sliding door, or even a part of a body of a person leaning against the sliding door, will be taken along by the automatically opening sliding door and be pinched. In connection with children in particular there is the chance that, because of a certain play instinct, they press their palms against the door panel. In connection with doors of chromium steel, such as were mainly used as sliding doors of elevators in the past, this hardly posed a danger because of the low coefficient of friction. However, glass sliding doors have been increasingly employed in connection with elevators in the last few years. Because of the unobstructed view of the operation of the elevator from the outside, sliding glass doors have a magical attraction for people, and particularly children. But the coefficient of friction between glass and the skin is relatively large. Moisture, for example sweat, on the skin additionally increases the adhesion of the skin to the glass surface. Because of this, the hand can be pulled along with the opening glass door and can be pinched at the pinching edge. This can lead to injury when it is attempted to release the hand.

It is therefore desirable to monitor the pinching edges at the automatic sliding doors of the elevator car and in the elevator shafts. To this end, presence sensors should be provided at all pinching edges of the elevator car and all pinching edges at the elevator shaft doors on all floors. In this connection the fact that the sliding doors on the elevator shaft are generally passive doors should be taken into consideration. This means that the elevator shaft doors of the respective floors can only be automatically opened together with the sliding door of the elevator car stopped in front of them. Customarily the drive mechanism for the sliding doors of the elevator car are located on the roof of the car. Appropriately embodied engagement elements on the sliding doors of the elevator car take care of opening the elevator shaft doors. A difficulty in the conversion of a system with a number of presence sensors lies, for example, in routing the signal of the elevator shaft door in front of which the elevator car is stopped to the elevator car so that, when required, the door opening mechanism can be changed to a slow opening mode or interrupted. Additional problems are posed by the logical linkage of the presence sensors, so that a correct operation of the elevator system is preserved. The multitude of sensors and the outlay to be expected have probably led in the past to the non-use of such elaborate safety mechanisms in connection with known elevator systems.

SUMMARY OF THE INVENTION

It is therefore an object of the present invention to remove the disadvantages of the elevator systems of the prior art. It is intended to create the prerequisites for making elevator systems with automatically operable sliding doors safe in such a way that a risk of injuries to the public has been removed to a great extent, even when using sliding glass doors. In the course of this it is intended to prevent objects from being pinched at the pinching edges of sliding doors, or people from sustaining injuries to their limbs, in particular their hands, because they are taken along by the opening sliding door and pinched. In the course of this, the normal operation of the sliding door should not be disturbed, and an unintentional or also intentional triggering of the safety mechanism in particular should be prevented. The safety mechanism should be suitable for simple retroactive installation. Unintentional or intentional damage to the safety mechanism should be prevented, and acts of vandalism should not be provoked at all.

An exemplary safety mechanism of the invention is designed for elevator systems with an elevator car, whose position in an elevator shaft can be changed. The entrances to the elevator shaft and to the elevator car each have at least one sliding door, which can be automatically operated by means of a drive mechanism which can be arranged at the elevator car. At least one detector device is provided at each sliding door, which is placed between a sliding door and a door jamb, and/or between two adjoining sliding door panels. Depending on the state of the monitored zones, the detector device generates a door release signal, or provides for the interruption of the drive mechanism for opening the sliding doors. The signals from the detector devices at the sliding doors of the elevator shaft can be received as a function of the position of the elevator car. Here, the signals from the detector device of a sliding door of the elevator shaft will be considered, which is to be automatically opened next, together with the sliding door of the elevator car.

Because of the logical linkage of the signals of the detector devices at the sliding doors of the elevator car and of the elevator shaft, only the signals at an elevator shaft door, which is to be opened next, can be considered. Because of this an effect because of signals from the detector devices at the remaining elevator shaft doors is prevented, and it is assured that no object in the monitored zone of the detector device at another sliding door on a different floor prevents the opening of the sliding doors next to be opened. In an exemplary embodiment, the logical linkage can be provided very simply even with a large number of detector devices, since it only relates to the detector devices at the elevator car and the elevator shaft door to be opened. Since the detector device generates the release signal at the passive elevator shaft door to be opened, and since the elevator shaft door can only be opened together with the elevator car door, dangerous malfunctions are prevented. The total structure of the safety mechanism is simple and comprehensible. The required installation outlay is comparatively low. This is of particular advantage in connection with retrofitting existing elevator systems.

The detector devices at the sliding doors are advantageously equipped with transmitting devices, which allow the transmission of information regarding the status of the monitored zone at the pinching edge(s) of the sliding door to a receiving device provided at the elevator car. This has the advantage that it is not necessary to conduct the signals over long signal lines and the elevator cable of the elevator car to the receiving device at the elevator car. For example, a transmission via contacts, for example wiper contacts, can be used. However, transmitting devices can be provided which allow the wireless transmission of signals.

In connection with a very simple variation of the invention, which offers advantages in installation and in the course of adjustment, the receiving device is a component of the detector device at the sliding door of the elevator car.

The detector devices at the sliding doors of the elevator shaft can be operated permanently. However, it has been shown to be advantageous for the service life of the sensor devices of the detector device if they can be put into operation as a function of the position of the elevator car. This can take place via the machine control, for example, which continuously monitors the position of the elevator car. Since push buttons for calling for the elevator car are arranged anyway at each elevator shaft door, this type of operating the detector device need not require particularly elaborate additional wiring.

In a variation of the invention, the detector devices at the elevator shaft doors can be activated by signals transmitted by the detector device at the sliding door of the elevator car. This solution represents a particularly dependable variation of the logical linkage of the signals from the detector device of the sliding doors of the elevator car and the elevator shaft door to be opened. In a further development of this activation principle it is possible to provide that the energy supply of the detector devices at the sliding doors of the elevator shaft takes place via the detector device of the sliding door of the incoming elevator car. It is assured by means of this that the detector devices at the sliding doors of the elevator shaft can only be activated if the elevator car is within the receiving range of the detector device at the elevator shaft door. Only then is the passive device changed into an active detector device, which checks the monitored zone for the presence of foreign objects and transmits a release signal to the detector device at the elevator car if required.

In an advantageous embodiment variation of the invention, the detector devices at the sliding doors of the elevator car and of the elevator shaft each have transmitting and/or receiving areas, which are pointed toward each other. In the course of the arrival and/or stop of the elevator car in front of the appropriate elevator shaft door, the transmitting and/or receiving areas overlap, by means of which the transmitting functions of the transmitters and receivers in the detector devices can be activated. By means of this arrangement the detector devices at the sliding doors of the elevator car and of the elevator shaft cannot only be electronically logically linked, but also cooperate spatially via the overlapping areas of the transmitting and/or receiving areas. Here, the overlapping areas are advantageously embodied in such a way that a sufficiently long period of time remains for transmitting warning signals or information to the public in front of the sliding doors, if necessary, prior to the stop of the elevator car in front of an elevator shaft door. It is possible by means of this to request people to move out of the monitored zone, or to remove their hands from the endangered area.

The signals provided by the detector device at the sliding doors of the elevator shaft provide information regarding one of the following three states: no object in the monitored zone detected, object detected, no elevator shaft sensor signal. The last one of the three states is advantageously used for the actual error protection of the sensor device. This is distinguished in that no signal is transmitted when the detector device fails. A missing signal from the detector device of the elevator shaft door in use then indicates to the receiving device at the elevator car that the drive mechanism for opening the sliding doors is not activated or is interrupted, and the sliding doors are not opened.

The detector devices for monitoring the pinching edges at the automatically operable sliding doors of the elevator car, or respectively the elevator shaft, can be vertically extending beads or lips, for example, which react to pressure and, in case of a mechanical deformation by an object or a body part, interrupt the drive mechanism of the automatic sliding door. The deformation of the beads or lips can be optically scanned, for example, or can activate a switch in a pneumatic way. The mentioned detection devices have only a relatively narrow monitoring range. Since they are activated by mechanical deformation immediately prior to the pinching of an object or a body part, they do not offer absolute protection because of the continued movement of the sliding door following the switch-off of the drive mechanism. In a very practical variation of the invention, which removes the disadvantages of beads or lips extending vertically at the pinching edges, the detector devices therefore can each comprise at least one electromagnetically and/or acoustically operating contactless presence sensor, whose monitored zone covers the vertically extending pinching edge and an area of the flat side of the sliding door, or of a sliding door panel, located in front of the pinching edge.

The employment of a presence sensor operating contactlessly on an electromagnetic or acoustic basis which monitors, besides the pinching edge, also an area of the sliding door, or of a sliding door panel, located in the area in front of the pinching edge, assures that accidents because of pinching of foreign objects are prevented. The increased monitored zone takes the continued movement of the sliding door after the door drive mechanism has been interrupted into account. At the same time, if a foreign object is detected in the monitored zone, this solution provides the opportunity to issue automatic warning signals or indications already prior to the opening of the sliding door. By means of a suitable control technique it can even be provided to initially operate the drive mechanism for opening the sliding door at reduced power and speed in case of the presence of a foreign object in the monitored zone, in order to provide sufficient time for the removal of the foreign body from the danger zone. The contactless presence sensor provided in the area of each pinching edge is insensitive to damage, because it can be completely integrated into the structure. If a presence sensor on the basis of invisible electromagnetic and/or acoustic signals is employed, there is practically no indication of its presence; potential acts of vandalism are therefore prevented from the start. But even when using presence sensors on the basis of visible signals, for example a light curtain, there is hardly a possibility of an unintentional or intentional damage because of the opportunity of integrating the sensor completely into the structure. Presence sensors on the basis of visible signals have the advantage that the danger area is directly indicated. The safety mechanism in accordance with the invention has a compact structure and is in particular also suited for equipping already existing automatically operable sliding door systems retroactively.

For safety reasons in view of the continued movement of the sliding door, and in order to offer a sufficiently long pre-warning time for the generation and issuance of warning signals, a monitored zone for the presence sensor is advantageous, which has its largest extension vertically in respect to the pinching edge and parallel with the flat side of the sliding door and which lies between at least 1 cm to approximately 20 cm or more, preferably approximately 5 cm. The upper limit can take into account the requirement that the opening sliding door must not be suddenly stopped by persons stepping through it.

For practical reasons, and also for preventing damage of the unintentional or also intentional kind, the presence sensor is arranged in the area of the upper edge of the pinching edge. Starting from the upper edge of the pinching edge, the monitored zone extends down to the floor where it has its largest extension parallel with the flat side of the sliding door in most cases. The shape of the monitored zone can here be designed in any arbitrary way. Its extension parallel to the flat side of the sliding door can be greater than its extension vertically to it. In many cases the monitored zone will have the shape of an ellipse, for example, which conically widens from the upper edge of the pinching edge toward the bottom. In an exemplary embodiment of the invention, the presence sensor comprises an integrated sending and receiving unit. This has the advantage that no installations, which could be unintentionally blocked or even damaged and could interfere with the functioning of the safety mechanism, are required at the surface located vertically opposite the presence sensor.

While there is the possibility of embodying the presence sensor directly as a switching element, for example in the manner of a photoelectrical barrier, it has been shown to be advantageous if the sensor is connected with an evaluation device. The latter controls the switching function of the detector service for the drive mechanism of the door in accordance with a predeterminable deviation pattern from a standard pattern, which can preferably be set, of the signals detected in the monitored zone. It is made possible by the employment of an evaluation unit to also convert switching criteria more complicated than the yes-no decision of a photoelectrical barrier in order to do justice to the specific requirements.

The evaluation of attenuated signal patterns has been proven to be advantageous for a particularly dependable functioning of the safety mechanism. The evaluation device is provided with a memory unit for this purpose, in which chronological and/or spatial attenuation curves of the signal pattern monitored by the presence sensor in the monitored zone are stored. In the course of the evaluation, these attenuation curves can be constantly automatically compared with the actually detected values in order to trigger the switching function for interrupting the door drive mechanism when the decision criteria have been met. The possibility of adapting the decision criteria to actuality is provided by means of a safety mechanism equipped in such a way. By means of this it is possible, for example, to take into consideration different reflection coefficients of different material in respect to the signals employed. The evaluating unit can also be designed to be "self-teaching", for example for also taking different degrees of brightness into consideration.

The safety mechanism in accordance with the invention offers great flexibility regarding the sensor means employed. For example, the contactless presence sensor can be an ultrasound sensor or a radar sensor, or a sensor for electromagnetic radiation in the visible and/or in the near UV or IR spectrum, or also a capacitive sensor. This allows the employment of the presence sensor which is most suited for the intended purpose. For example, a visible light curtain has proven itself useful in connection with elevators which can be easily viewed and monitored and can furthermore also satisfy designer aspects. However, sensing devices with an invisible monitoring zone can be employed with elevator systems which are subject to increased danger of vandalism.

In the contactless embodiment, the sensor coupling in accordance with the invention can also be used for forwarding information from the elevator car to the door of the respective floor or vice versa. This has been shown to be advantageous for older elevator systems in particular, which in this way can be retrofitted very simply, without elaborate installations to meet modern requirements. The transmitted information can be information regarding presences, which activates a light indicator or an acoustic signal at the door of the respective floor. By means of using appropriate sensor devices it is also possible to transmit information regarding the number of unoccupied spaces in the elevator car. The coupling of sensors in the elevator car and the door of the respective floor basically permits the transmission of any arbitrary information, whose contents only depend on the sensors used.

An exemplary method in accordance with the invention for operating a safety mechanism for elevator systems, having an elevator car whose position in an elevator shaft can be changed, relates to an elevator system wherein at least one sliding door each is provided for the entries to the elevator shaft and the elevator car. The sliding doors are automatically operated by means of a drive mechanism, which can be arranged at the elevator car. At least one detector device is provided at each sliding door, which is arranged in the area of a pinching edge between a sliding door and a door jamb, and/or between two adjoining sliding door panels. Depending on the status of the monitored zones, the detector devices generate a door release signal or they interrupt the drive mechanism for opening the sliding doors. The signals of the detector devices at the sliding doors of the elevator shaft are received as a function of the position of the elevator car. The signals from the detector device of the sliding door of the elevator shaft, which is intended to be next opened automatically together with the sliding door of the elevator car, are considered for the decision of releasing the door. The detector devices of the elevator car and of the elevator shaft door which is next to be opened are logically linked by this process. It is assured by means of this that the opening of the sliding doors is not prevented by an object located in the monitoring zone of the detector device of the elevator shaft door on a different floor.

It has been shown to be practical for the logical linking of the detector devices if the detector device of the elevator shaft door which is intended to be opened next transmits signals regarding the status of its monitored zone. These signals are received by the detector device at the sliding door of the elevator car which is arriving or stopped in front of the elevator shaft door and will be processed for the decision regarding the release of the sliding doors. The transmission of the signals here advantageously takes place in a wireless manner.

For the greatest possible error protection, the drive mechanism for opening the elevator car door is not activated, or is interrupted, in case of a missing detector signal from the elevator shaft door just in use at that time.

In an embodiment variation of the invention and the associated employment of the method, which is particularly attractive in regard to installation technology, the detector devices at the sliding doors of the elevator shaft are supplied with energy by means of the detector device at the sliding door of the arriving elevator car. The energy supply can take place, for example, by the emanation of an energy-rich radiation, or inductively.

The invention will be explained in greater detail in what follows by means of exemplary embodiments shown in the drawings, which provide schematic representations, not to scale.

BRIEF DESCRIPTION OF THE DRAWINGS

The invention will be described below in terms of an exemplary embodiment shown in the drawings. In partly schematic views not to scale, the drawings show:

FIGS. 3 to 6 show different arrangements of sensors along a pinching edge, according to exemplary embodiments of the present invention.

DETAILED DESCRIPTION OF THE PREFERRED EMBODIMENTS

Figure 1:
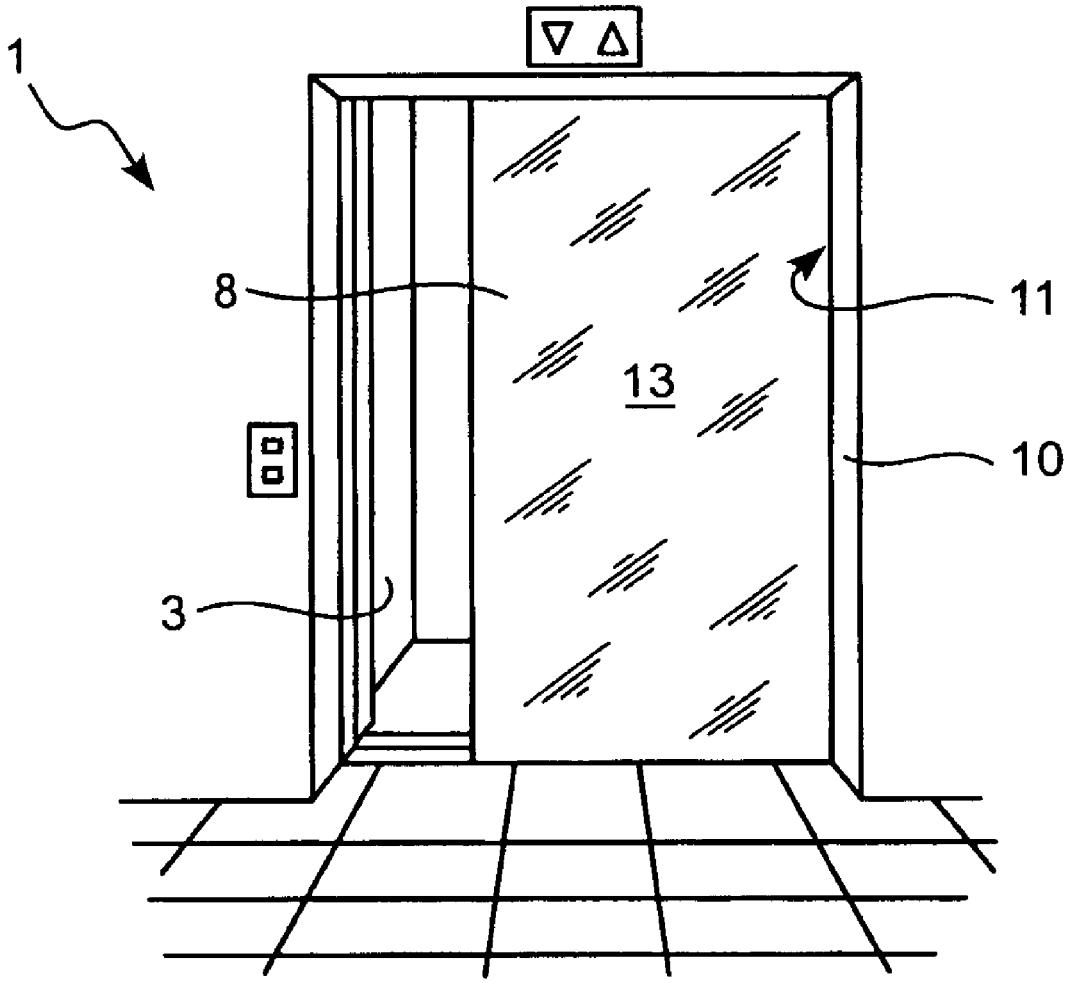
Prior Art FIG. 1
FIGS. 1 and 2 show an elevator system in accordance with the prior art.
Figure 2:
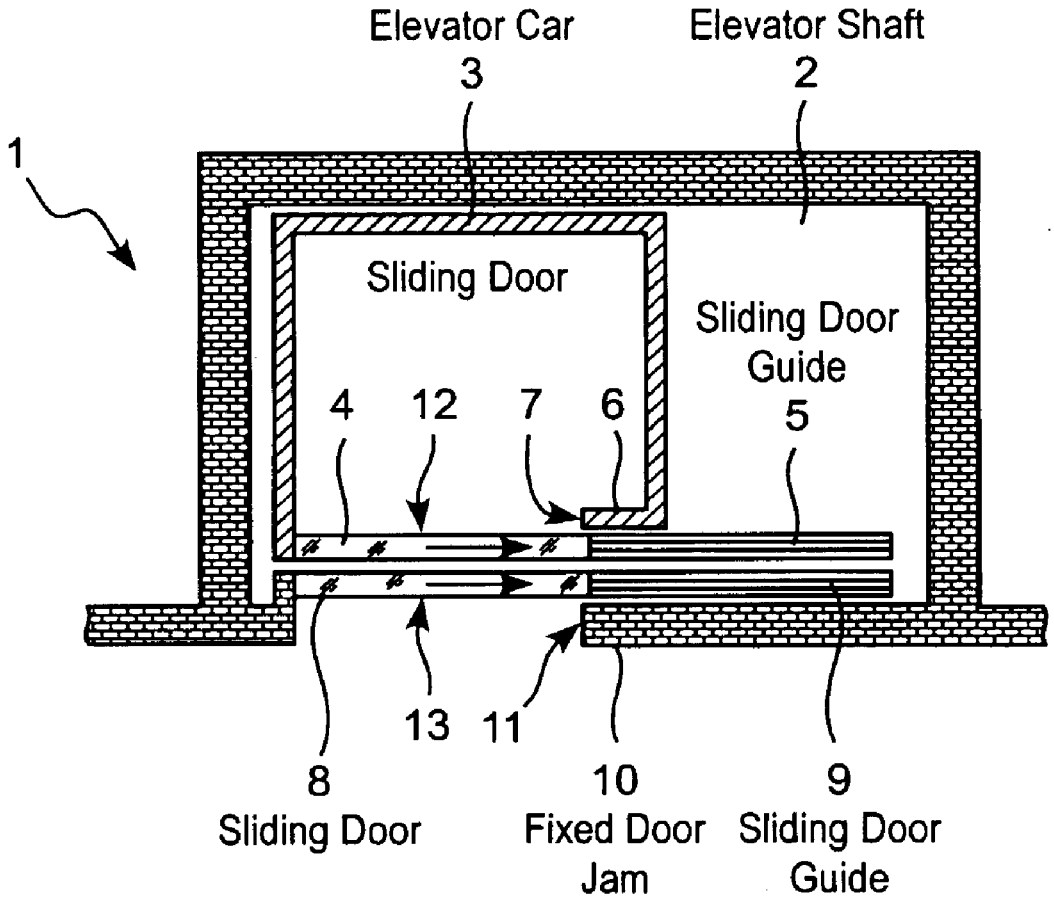
Prior Art FIG. 2

In FIGS. 1 and 2, an elevator system as a whole is identified by the reference numeral 1. It comprises an elevator shaft 2 and an elevator car 3, whose position in the elevator shaft can be changed. The elevator car 3 is moved by means of a motor in a known manner. Sliding doors 8, or 4, which are automatically operable, are respectively provided at the entrances to the elevator shaft 2 and the elevator car 3. Customarily the sliding doors 4, 8 can only be actuated together. In this case, the sliding door 4 of the elevator car 3 is an actively operable door, which is driven by a motor usually arranged on the roof of the elevator car 3. The sliding door 8 at the elevator shaft is a purely passive door, which can be operated by means of engagement elements on the sliding door 4 of the elevator car 3. The sliding doors 8, or 4, slide in sliding door guides, which are indicated by the reference numerals 9, or 5, in FIG. 2. The sliding doors 8, or 4, can be displaced in relation to fixed walls of the elevator shaft 2 and the elevator car 3. Relevant to the invention here in the case of the elevator car 3 is the fixed door jamb 6, and for the elevator shaft the fixed door jamb 10. Pinching edges are formed between the movable sliding doors 4, or 8, and the fixed door jambs 6, or 10, which are provided with the reference numeral 7 at the elevator car 3, and with the reference numeral 11 at the elevator shaft 2. It can be directly seen from the representations in FIGS. 1 and 2 that an object, or a part of a body, which leans against, or is held on the flat sides 12, 13 of the sliding doors 4, 8 facing the public, is in danger of being pinched at the pinching edges 7, or 11. While the danger of pinching is less with chromium-steel doors, with glass doors, which lately are increasingly employed also with elevator systems, the pinching edges 7, 11 represent a not inconsiderable risk. Glass has an increased coefficient of friction in respect to the skin in particular. Considering that glass sliding doors, especially of elevator systems, have a magical attraction for the public, in particular children, because of the fascinating view of the technical parts of the elevator, the need for a dependable safety system becomes immediately obvious.

A variation of a safety mechanism in accordance with the invention for preventing pinching at the pinching edge 27 between a fixed door jamb 22 and the sliding door 23, automatically opening in the sliding door guide 24, is represented in FIGS. 3 and 4. The safety mechanism comprises a detector device 20 with a number of contactless presence detectors 21 arranged vertically above each other, which monitor the pinching edge 27. The distance between the presence detectors 21 has been selected to be such that their monitored zone 26 essentially adjoin each other in the vertical direction. The presence detectors 21 are installed in such a way in, or on, the fixed door jamb 22, that their monitored zones 26 have a greater extension in a direction parallel with the flat side 25 of the sliding door 23 than vertically to it. The extension of the monitored zones 26 parallel with the flat side 25 of the sliding door 23 is approximately 1 cm to approximately 20 cm or more, preferably approximately 5 cm.

Figure 5:
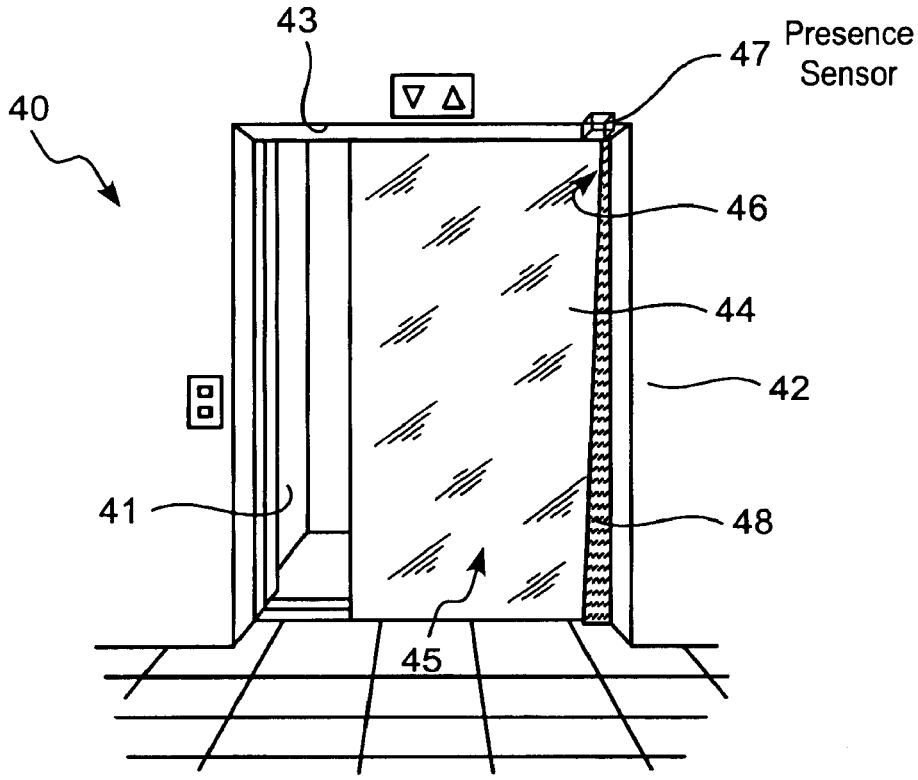

FIGS. 5 and 6 show a modified arrangement of a detector device for making automatically operable sliding doors safe. The elevator system represented is here identified by 40 as a whole. The elevator car has the reference numeral 41. The sliding door 44 made of glass, represented in FIGS. 5 and 6, is a part of the elevator shaft and covers the sliding glass door of the elevator car 41. The fixed door jamb of the elevator shaft is identified by 42. The pinching edge relevant to safety between the fixed door jamb 42 of the elevator shaft and the flat side 44 of the sliding door has the reference numeral 46. Differing from the presence sensors arranged vertically above each other along the pinching edge 46 in FIG. 3, the pinching edge 46 in the exemplary embodiment shown is monitored by a single contactless presence sensor 47, which is mounted in, or on the horizontal lintel 43. The presence sensor 47 is arranged in the area of the pinching edge 46 and has a monitoring zone 48, which widens approximately conically, starting at the sensor 47, in the direction toward the floor. The monitoring zone 48 has its greatest extension parallel with the flat side 45 of the sliding door 44, which is approximately 1 cm and up to approximately 20 cm or more, preferably approximately 5 cm, and which for practical reasons is greater than its extension vertically to this. For example, the shape of the monitored zone is approximately elliptical. The remarks regarding the sensors in the exemplary embodiments in accordance with FIGS. 3 to 5 analogously apply to the embodiment of the single presence sensor 47. FIGS. 5 and 6 only show the arrangement of one presence sensor 47 at the pinching edge 46 between the door jamb 42 of the elevator shaft and the elevator shaft door 44. It is understood that the pinching edge of the elevator car is made safe in an analogous manner.

Figure 7:
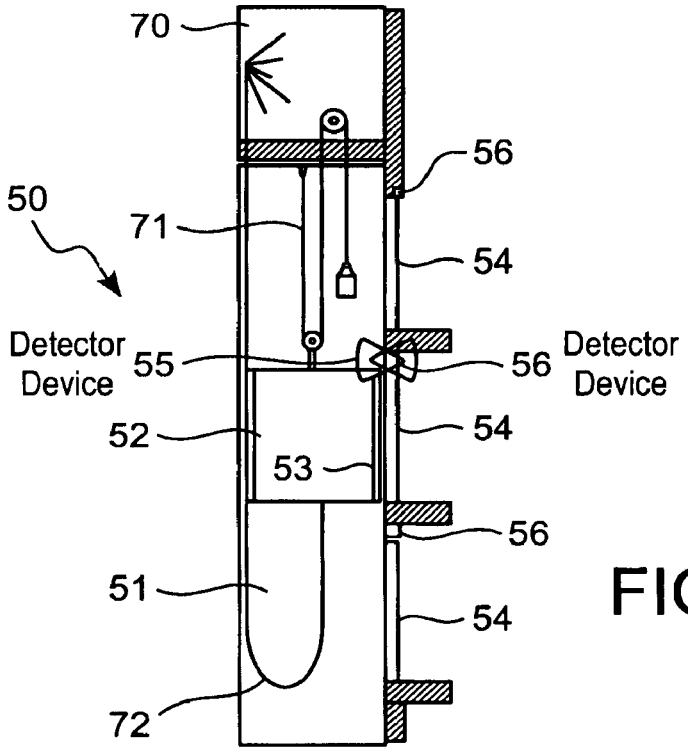
FIG. 7 is a representation of the totality of an elevator system equipped in accordance with an exemplary embodiment of the invention.

FIG. 7 shows the total view of an elevator system, identified by 50 as a whole. The elevator system has a vertically extending elevator shaft 51, in which an elevator car 52 can be moved from floor to floor by means of a motor. The motor drive for the elevator car 52 is housed in a machine shed 70, which customarily closes the elevator shaft off at the top. The suspension of the elevator car 52 is indicated at 71. An elevator cable 72 is used for transmitting the signals from the machine control housed in the machine shed 70 to the elevator car 52. The elevator shaft 51 has an entry on every floor, which is closed by an automatically operable sliding door 54. The elevator car 52 has a sliding door 53. The pinching edges of the sliding doors 53, 54 are monitored by detector devices 55, 56, so that objects or body parts in the monitored zone can be detected in time and the opening of the sliding doors 53, 54 can be prevented. The unusual feature of the embodiment in accordance with the invention of the elevator system 50 rests in that the signals from the detector devices 56 at the sliding doors 54 of the elevator shaft 51 can be received as a function of the position of the elevator car 52. Only the signals from the detector device 56 of the sliding door 54 of the elevator shaft 51, which is to be automatically opened next together with the sliding door 53 of the elevator car 51, are considered here.

Figure 8:
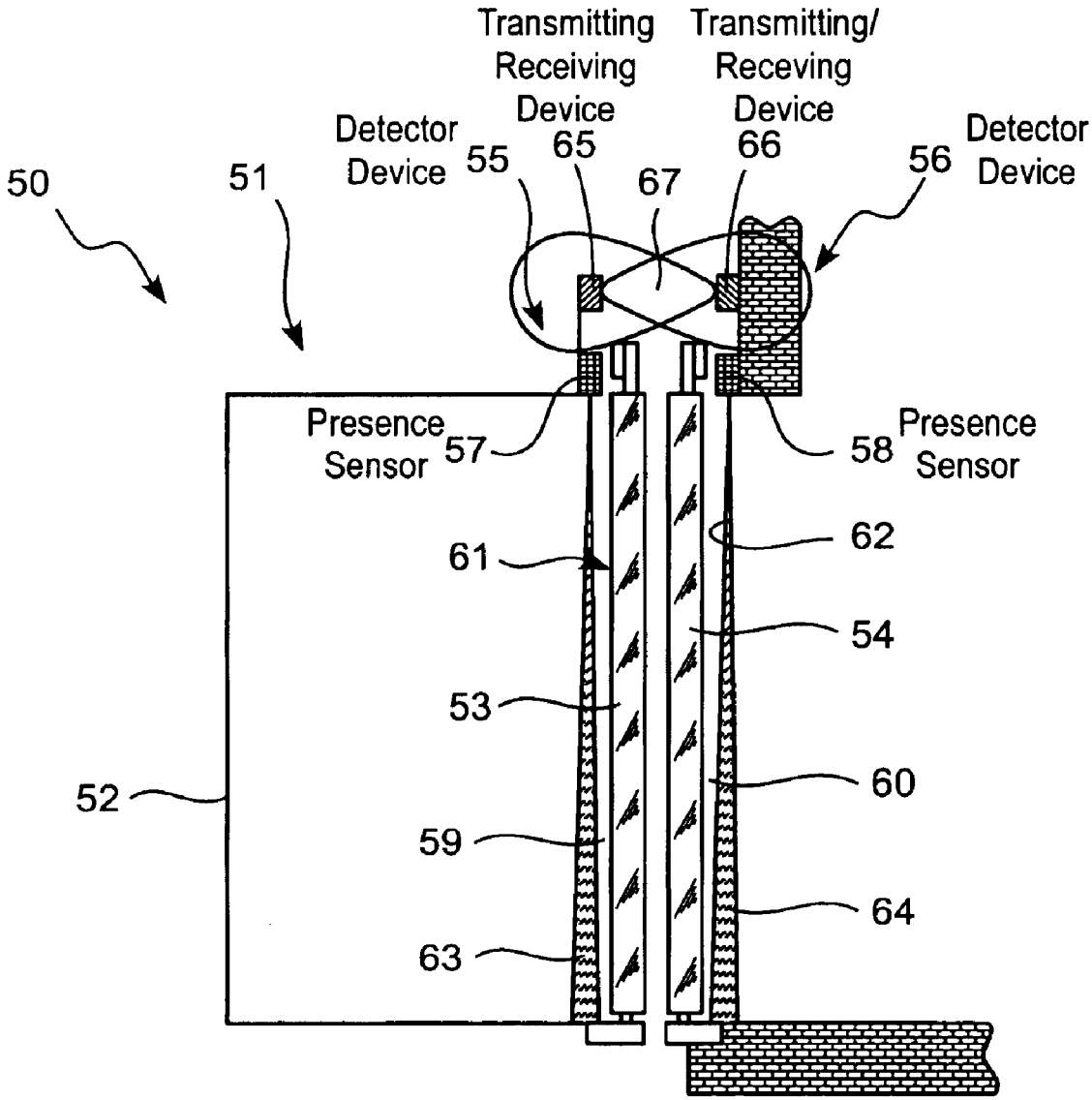
FIG. 8 is an enlarged detail representation of the elevator system in FIG. 7.

FIG. 8 shows the elevator car 52 stopped on a floor in front of the sliding door 54 of the elevator shaft 51 which is to be opened next. The detector devices 55, 56 provided in the area of the pinching edges 59, 60 of the sliding doors 53, 54 correspond for example to the ones represented in FIG. 5. The detector devices 55, 56 define monitored zones 63, 64 at the flat sides 61, 62 of the sliding doors 53, 54 facing the public. The detector device 56 of the elevator shaft door 54 can be activated as a function of the position of the elevator car 52. For this purpose, the detector devices 55, 56 at the sliding door 53 of the elevator car 52 and on the elevator shaft door 54 have been provided with transmitting and receiving devices 65, 66 in addition to the presence sensors 57, 58. They are used to always activate exactly the detector device 56 of that elevator shaft door 54 which is intended to be next opened, together with the sliding door 53 of the elevator car 52. In this way it is dependably prevented that the opening of the sliding doors is not prevented by a foreign object in the monitored zone of the detector device at the elevator door on another floor. The transmitting and receiving devices 65, 66 can be ultrasound or microwave emitters and receivers, for example. It is also possible to employ capacitive signal emitters and receivers. The transmitting and receiving device 65, 66 has an overlap area. Because of this, the detector device 56 of the elevator shaft door 54 can already be activated before the elevator car 52 stops. This makes it possible, for example, to provide warning signals or information to the public waiting in front of elevator shaft door 54, so that they move out of the directly monitored zone. In a further variation of the invention, the transmitting and receiving devices can be embodied in such a way that the detector device 56 at the elevator shaft door 54 is supplied with energy via the detector device 55 at the sliding door 53 of the elevator car 52. This can take place, for example, by the emanation of an energy-rich microwave radiation, or inductively. Because of this, no separate energy supply wiring is required for the detector devices 56 at the elevator shaft doors 54. This is a great advantage, particularly when retrofitting existing elevator systems with a safety mechanism in accordance with the invention.

The variations of arrangements of presence sensors represented in FIGS. 3 to 8 are based on the use of contactless sensors on an acoustic, electromagnetic or capacitive basis. In particular, the contactless presence sensors can be ultrasound sensors or radar sensors, or sensors for electromagnetic radiation in the visible and/or near UV or IR spectrum, for example. The presence sensors preferably have an integrated transmitting and receiving unit each, which emits the check signal, or receives the returned signals. The presence sensors can also be sensors operating on a capacitive basis. The presence sensors are connected with an evaluation device, not further represented, which is integrated into the detector device. The former controls the switching function of the detector device for the door drive mechanism in accordance with a predeterminable deviation pattern from a preferably settable standard pattern of the signals detected by the presence sensors in the monitored zone. Chronological and/or spatial attenuation curves can be employed for evaluation, which are stored in a memory unit of an evaluation device, which is a part of the detector device. In the course of evaluation, these attenuation curves can be constantly and automatically compared with the actually detected values in order to trigger the switching operation for the interruption of the door drive mechanism when the decision criteria have been met. The possibility of adapting the decision criteria to actuality is provided with a safety mechanism equipped in such a way. By means of this it is possible, for example, to take into consideration different reflection coefficients of different materials in respect to the signals employed. The evaluating unit can also be designed to be "self-teaching", for example for also taking into consideration different degrees of brightness. The presence sensors are customarily operated in a pulsed manner.

While the described detector devices with contactless presence sensors are preferred for a particularly dependable variation of a safety mechanism for elevator systems, the embodiment in accordance with the invention is, however, not limited to such sensors. The pinching edges can also be monitored by detector devices which, for example, comprise vertically extending beads or lips, which react to pressure and, in case of a mechanical deformation by an object or a body part, interrupt the drive mechanism of the automatic sliding door. The deformation of the beads or lips can be optically scanned, for example, or can activate a switch in a pneumatic way. The mentioned detection devices have only a relatively narrow monitoring range. Since they are activated by mechanical deformation only immediately prior to the pinching of an object or a body part, they do not offer absolute protection because of the continued movement of the sliding door following the switch-off of the drive mechanism.

The variations of safety mechanisms for sliding doors explained by way of example are not limited to elevator systems with single sliding doors. In the case of multi-part sliding doors, further pinching edges appear between adjoining door panels. It is understood that the additional pinching edges are monitored in an analogous manner and take part in the decision regarding the release or blockage of the door opening.

The method in accordance with the invention for operating a safety mechanism for elevator systems, having an elevator car whose position in an elevator shaft can be changed, relates to an elevator system wherein at least one sliding door each is provided for the entries to the elevator shaft and the elevator car. Such an elevator system is represented in FIGS. 7 and 8 in particular and is provided with the reference numeral 50 as a whole. The sliding doors 53, 54 are automatically operated by means of a drive mechanism, which is preferably arranged at the elevator car 52. At least one detector device 55, 56 is provided at each sliding door 53, 54, which is arranged in the area of a pinching edge 59, 60 between a sliding door and a door jamb, and/or between two adjoining sliding door panels. Depending on the status of the monitored zones 63, 64, the detector devices 55, 56 generate a door release signal or they interrupt the drive mechanism for opening the sliding doors 53, 54. The signals of the detector devices 55, 56 at the sliding doors 54 of the elevator shaft 51 are received as a function of the position of the elevator car 52. Only the signals from the detector device 56 of the sliding door 54 of the elevator shaft 51, which is intended to be next opened automatically together with the sliding door 53 of the elevator car 52, are considered for the decision of releasing the door. The detector devices 55, 56 of the elevator car 52 and of the elevator shaft door 51 which is next to be opened are logically linked by this process. It is assured by means of this that the opening of the sliding doors 53, 54 is not prevented by an object located in the monitoring zone 64 of the detector device 56 of the elevator shaft door 54 on a different floor.

It has been shown to be practical for the logical linking of the detector devices 55, 56 if, for example, the detector device 56 of the elevator shaft door 54 which is intended to be opened next transmits signals regarding the status of its monitored zone 64. These signals are received by the detector device 55 at the sliding door 53 of the elevator car 52 which is arriving or stopped in front of the elevator shaft door 54 and will be processed for the decision regarding the release of the sliding doors (53, 54). The transmission of the signals here advantageously takes place in a wireless manner.

For the greatest possible error protection, the drive mechanism for opening the elevator car door 52 is not activated, or is interrupted, in case of a missing detector signal from the elevator shaft door 54 just in use at that time.

In an embodiment variation of the invention and the associated employment of the method, which is particularly attractive in regard to installation technology, the detector devices 56 at the sliding doors 54 of the elevator shaft 51 are supplied with energy by means of the detector device 55 at the sliding door 53 of the arriving elevator car 52. The energy supply can take place, for example, by the emanation of an energy-rich radiation, for example microwave radiation, or inductively.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A safety mechanism for elevator systems having an elevator car, whose position in an elevator shaft can be changed, wherein plural entrances to the elevator shaft and to the elevator car each have at least one sliding door which is automatically operable by means of a drive mechanism, the safety mechanism comprising:

at least one detector device provided at each sliding door to monitor a zone of at least one pinching edge between a sliding door and a door jamb, and/or between two adjoining sliding door panels of the sliding door which, depending on the state of the monitored zones, generates a door release signal, or interrupts the drive mechanism for opening the sliding door, wherein the signal from the detector device at one of plural elevator shaft sliding doors is received as a function of a position of the elevator car, the signal from the detector device of the elevator shaft sliding door which is considered is that of the elevator shaft sliding door which is to be automatically opened next with the sliding door of the elevator car, and the detector device at each sliding door of the elevator car and of the elevator shaft each have transmitting and/or receiving devices, which are pointed toward each other, whose transmitting and/or receiving areas overlap upon arrival and/or stop of the elevator car in front of the respective elevator shaft door.

2. The safety mechanism in accordance with claim 1, wherein the detector device at the sliding door of the elevator shaft is equipped with a transmitting device, for transmission of information regarding a status of the monitored area of the crushing edges of the sliding door to a receiving device provided at the elevator car.

3. The safety mechanism in accordance with claim 2, wherein the receiving device is a component of the detector device at the elevator car sliding door.

4. The safety mechanism in accordance with claim 1, wherein the detector device at the sliding door of the elevator shaft is put into operation as a function of the position of the elevator car.

5. The safety mechanism in accordance with claim 4, wherein the detector device at the sliding door of the elevator shaft is activated by a signal emitted by the detector device at the sliding door of the elevator car.

6. The safety mechanism in accordance with claim 5, wherein an energy supply for the detector device at the sliding door of the elevator shaft is received via the detector device at the sliding door of the elevator car.

7. The safety mechanism in accordance with claim 1, wherein the overlapping area of the transmitting and/or receiving devices is embodied in such a way that a sufficiently long period of time remains prior to a stop of the elevator car in front of an elevator shaft door for transmitting warning signals or information in front of the sliding doors.

8. The safety mechanism in accordance with claim 1, wherein upon a missing receiving signal from the detector device of the elevator shaft door in use, the drive mechanism for opening the sliding doors is interrupted.

9. The safety mechanism in accordance with claim 1, wherein the detector device comprises:

at least one electromagnetically and/or acoustically operating contactless presence sensor, whose monitored area covers a vertically extending crushing edge and an area located in front of the crushing edge of a flat surface of the sliding door, or of a sliding door panel.

10. The safety mechanism in accordance with claim 9, wherein the monitored area for the presence sensor has its largest extension vertically in respect to the crushing edge and parallel with the flat surface of the sliding door which is approximately 1 cm to approximately 20 cm.

11. The safety mechanism in accordance with claim 10, wherein the presence sensor is arranged in an area of an upper edge of the crushing edge.

12. The safety mechanism in accordance with claim 11, wherein the presence sensor is connected with an evaluation device, which controls a switching function of the detector device for the drive mechanism in accordance with a predeterminable deviation pattern from a settable signal pattern of signals detected by the presence sensor in the monitored area.

13. The safety mechanism in accordance with claim 12, wherein the evaluation device has a memory unit, in which chronological and/or spatial attenuation curves of the signal pattern detected by the presence sensor in the monitored area are stored, which are automatically compared in the evaluation device with actual detected values in order to trigger the switching function when decision criteria have been met.

14. The safety mechanism in accordance with claim 9, wherein the contactless presence sensor is an ultrasound sensor, or a radar sensor, or a sensor for electromagnetic radiation in the visible and/or in near UV or IV spectrum, or a capacitive sensor.

15. A safety mechanism in accordance with claim 1, wherein detection by the detector device is based on detecting variation of electromagnetic or acoustic radiation in the monitored zone of the at least one pinching edge.

16. The safety mechanism, of claim 2, wherein the transmitting device provides wireless transmission.

17. The safety mechanism in accordance with claim 9, wherein the monitored area for the presence sensor has its largest extension vertically in respect to the crushing edge and parallel with the flat surface of the sliding door which is approximately 5 cm.

18. The safety mechanism of claim 1, wherein said overlap of transmitting and/or receiving areas of said detector device at each sliding door of the elevator car and of the elevator shaft serve for an activation for the monitoring functions of the detector device in the area of the pinching zones.

19. A method for operating a safety mechanism for operating elevator system having an elevator car, whose position in an elevator shaft can be changed, wherein plural entrances to the elevator shaft and to the elevator car each have at least one sliding door which is automatically operable by means of a drive mechanism, at least one detector device is provided on each sliding door, which is arranged to monitor a zone of a pinching edge between a sliding door and a door jamb, and/or between two adjoining sliding door panels of the sliding door, and the detector device at each sliding door of the elevator car and of the elevator shaft each have transmitting and/or receiving devices, which are pointed toward each other, whose transmitting and/or receiving areas overlap upon arrival and/or stop of the elevator car in front of the respective elevator shaft door, the method comprising:

generating, as a function of a status of a monitored zone, a door release signal or interrupting the drive mechanism for opening the sliding door;

receiving signals from the detector device at a sliding door of the elevator shaft as a function of the position of the elevator car; and considering the signal from the detector device of the sliding door of the elevator shaft which is to be automatically opened next together with the sliding door of the elevator car.

20. The method in accordance with claim 19, wherein the detector device of the elevator shaft door which is to be opened next, transmits signals regarding the status of its monitored area, which are received by the detector device at the sliding door of the elevator car which is arriving, or stops in front of the elevator shaft door, and are processed for a decision regarding a release of the sliding doors of the elevator car and the elevator shaft.

21. The method in accordance with claim 20, wherein upon a missing detector signal from the elevator shaft door just in use, the drive mechanism for opening the elevator door is not activated, or is interrupted.

22. The method in accordance with one of claim 21, wherein the detector device at the sliding door of the elevator shaft is supplied with energy via the detector device of the sliding door of the elevator car.

23. The method in accordance with claim 19, wherein said overlap of transmitting and/or receiving areas of said detector device at each sliding door of the elevator car and of the elevator shaft activate the monitoring functions of the detector device in the area of the pinching zones.

* * * * *